US006317578B1

(12) United States Patent
Kusayanagi

(10) Patent No.: US 6,317,578 B1
(45) Date of Patent: Nov. 13, 2001

(54) WET-TYPE IMAGE FORMING DEVICE AND CLEANING APPARATUS

(75) Inventor: Toshiya Kusayanagi, Niigata (JP)

(73) Assignee: NEC Corporation, Tokyo (JP)

( * ) Notice: Subject to any disclaimer, the term of this patent is extended or adjusted under 35 U.S.C. 154(b) by 0 days.

(21) Appl. No.: 09/689,822

(22) Filed: Oct. 13, 2000

(30) Foreign Application Priority Data

Oct. 14, 1999 (JP) ..... 11-292414

(51) Int. Cl.[7] ..... G03G 21/00
(52) U.S. Cl. ..... 399/348; 399/249
(58) Field of Search ..... 399/348, 354, 399/249, 357, 245

(56) References Cited

U.S. PATENT DOCUMENTS 3,884,572 * 5/1975 Bacon et al. ..... 399/129
4,482,244 * 11/1984 Yamazaki et al. ..... 399/356
5,530,537 * 6/1996 Thayer ..... 399/357
5,978,630 * 11/1999 Chang et al. ..... 399/249

* cited by examiner

*Primary Examiner*—Robert Beatty

(57) ABSTRACT

A wet-type image forming device includes a development roller, a squeeze roller, a cleaning roller, a brush roller, and a reservoir, with voltages being applied to these components. A portion of one side of the reservoir is bent in a V-shape to form a protrusion so as to scrape toner particles from the brush roller. Toner particles adhering to the cleaning roller are mostly removed therefrom to sequentially adhere to the brush roller by a potential difference between the cleaning roller and the brush roller, and by opposing rotation of the cleaning roller and the brush roller in contact therewith. Toner particles remaining on the cleaning roller are scraped off by a cleaning blade to also adhere to the brush roller. Toner particles adhering to the brush roller are scraped off by the protrusion of the reservoir and are then dispersed in the liquid developer within the reservoir.

16 Claims, 6 Drawing Sheets

WET-TYPE IMAGE FORMING DEVICE AND CLEANING APPARATUS

BACKGROUND OF THE INVENTION

1. Field of the Invention

The present invention generally relates to wet-type image forming devices and to electrophotographic apparatuses. More specifically, the present invention relates to a wet-type image forming device which employs electrophotography to render visible, using a liquid developer, an electrostatic latent image formed on a photoreceptor, and to an electrophotographic apparatus incorporating the wet-type image forming device.

2. Description of the Related Art

FIG. 1 shows a schematic sectional view of a conventional wet-type image forming device 100*a*. During image formation, within non-discharged areas, which were not exposed to light, of a photoreceptor belt B, a potential difference between the photoreceptor belt B and a development roller 1 generates an electric field having an opposite direction as in discharged areas, which were exposed to light, of the photoreceptor belt B. Accordingly, a reverse development occurs; i.e., toner particles T' adhere to the development roller 1. Consequently, problems may arise in the course of subsequent image forming operations such as the image density becoming too high, and a constant gap not being maintained between the photoreceptor belt B and the development roller 1. Thus, the development roller 1 is cleaned using a potential difference between the development roller 1 and a cleaning roller 3.

Also, toner particles T' adhere to a squeeze roller 2 when excess liquid developer T is squeezed off from a developed image formed on the photoreceptor belt B. Consequently, problems may arise in the course of subsequent image forming operations such as the photoreceptor belt B becoming stained as the squeeze roller 2 continues to rotate, and the ability to squeeze off excess liquid developer T being progressively diminished. Thus, the squeeze roller 2 is cleaned using a potential difference between the squeeze roller 2 and the cleaning roller 3.

Due to the cleaning of the development roller 1 and the cleaning of the squeeze roller 2, the cleaning roller itself picks up toner particles T'. As the cleaning roller 3 picks up more toner particles T', the potential differences tend to become insufficient for cleaning between the development roller 1 and the cleaning roller 3, and between the squeeze roller 2 and the cleaning roller 3. Thus, the cleaning roller 3 itself is also cleaned.

In the conventional wet-type image forming device 100*a*, the cleaning roller 3 has been cleaned by opposing rotation of the cleaning roller 3 and a brush roller 5*a* in contact therewith, and by a cleaning blade 4 contacting the cleaning roller 3. That is, the cleaning of the cleaning roller 3 has been performed by mechanical force alone.

The mechanical cleaning, however, has not been sufficient to fully remove the toner particles T' from the cleaning roller 3. Therefore, the conventional wet-type image forming device 100*a* has been susceptible to a subsequent problem that the development roller 1 and the squeeze roller 2 are not adequately cleaned.

Furthermore, the conventional wet-type image forming device 100*a* has not been capable of removing toner particles T' adhering to the brush roller 5*a*. Therefore, the conventional wet-type image forming device 100*a* has also been disadvantageous in that the toner particles T' accumulate on the brush roller 5*a*, reducing the ability to remove toner particles T' from the cleaning roller 3 and the cleaning blade 4.

SUMMARY OF THE INVENTION

Accordingly, it is an object of the present invention to provide a wet-type image forming device and an electrophotographic apparatus in which toner particles can be fully removed from the surface of a cleaning roller.

It is another object of the present invention to provide a wet-type image device and an electrophotographic apparatus in which the ability to clean the cleaning roller does not diminish over an extended period of image forming operations.

To this end, the present invention, in one aspect thereof, provides a wet-type image forming device which includes a development roller for developing, using a liquid developer, an electrostatic latent image formed on a photoreceptor, a squeeze roller for squeezing off excess liquid developer from the photoreceptor, a cleaning roller for cleaning the development roller and the squeeze roller, and a brush roller and a cleaning blade for cleaning the cleaning roller, and in which a voltage is applied to the brush roller.

The present invention in another aspect thereof, provides an electrophotographic apparatus comprises a wet-type image forming device, wherein the image forming device includes a development roller for developing, using a liquid developer, an electrostatic latent image formed on a photoreceptor, a squeeze roller for squeezing off excess liquid developer from the photoreceptor, a cleaning roller for cleaning the development roller and the squeeze roller and a brush roller and a cleaning blade for cleaning the cleaning roller, wherein a voltage being applied to the brush roller.

The present invention, in still another aspect thereof, provides a wet-type image forming device which includes a development roller for developing, using a liquid developer containing toner particles, an electrostatic latent image formed on a photoreceptor, a squeeze roller for squeezing off excess liquid developer from the photoreceptor, a cleaning roller for cleaning the development roller and the squeeze roller, a brush roller and a cleaning blade for cleaning the cleaning roller, and a scraping mechanism for scraping toner particles from the brush roller.

The present invention in still another aspect thereof, provides a wet-type image forming device which includes a development roller for developing, using a liquid developer containing toner particles, an electrostatic latent image formed on a photoreceptor, a squeeze roller for squeezing excess liquid developer from the photoreceptor, a cleaning roller for cleaning the development roller and the squeeze roller, a brush roller and a cleaning blade for cleaning the cleaning roller, and a reservoir for storing the liquid developer so that the brush roller is immersed therein during image formation, and in which the reservoir has a protrusion for scraping toner particles from the brush roller.

DESCRIPTION OF THE PREFERRED EMBODIMENTS

Three embodiments of the present invention are described hereinbelow. Electrophotographic apparatuses are used in printers, copying machines, facsimile machines, etc. An electrophotographic apparatus according to the present invention employs a photoreceptor belt, and, as a developing unit, a wet-type image forming device in which a liquid developer is used. In operation, initially a charger charges the photoreceptor belt; a laser unit then performs a light exposure process to form an electrostatic latent image on the photoreceptor belt; an image forming device then renders the latent image visible; a drying unit then dries the developed image on the photoreceptor belt; and finally a transfer unit transfers the image onto a sheet of paper.

A first embodiment of the present invention will now be described with reference to FIGS. 2 to 6.

Figure 1:
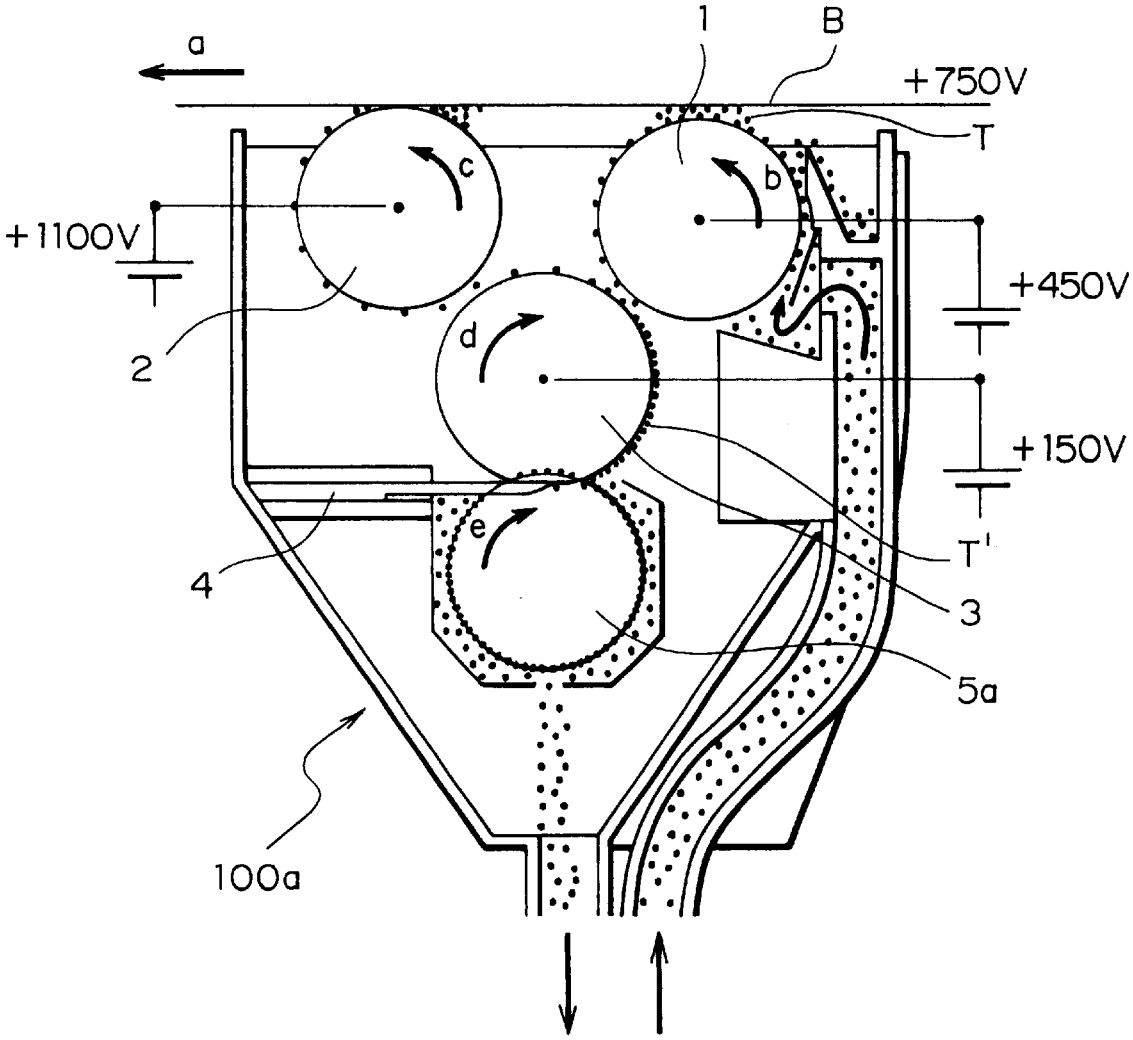
FIG. 1 PRIOR ART
FIG. 1 is a schematic sectional view of a conventional wet-type image forming device.
Figure 2:
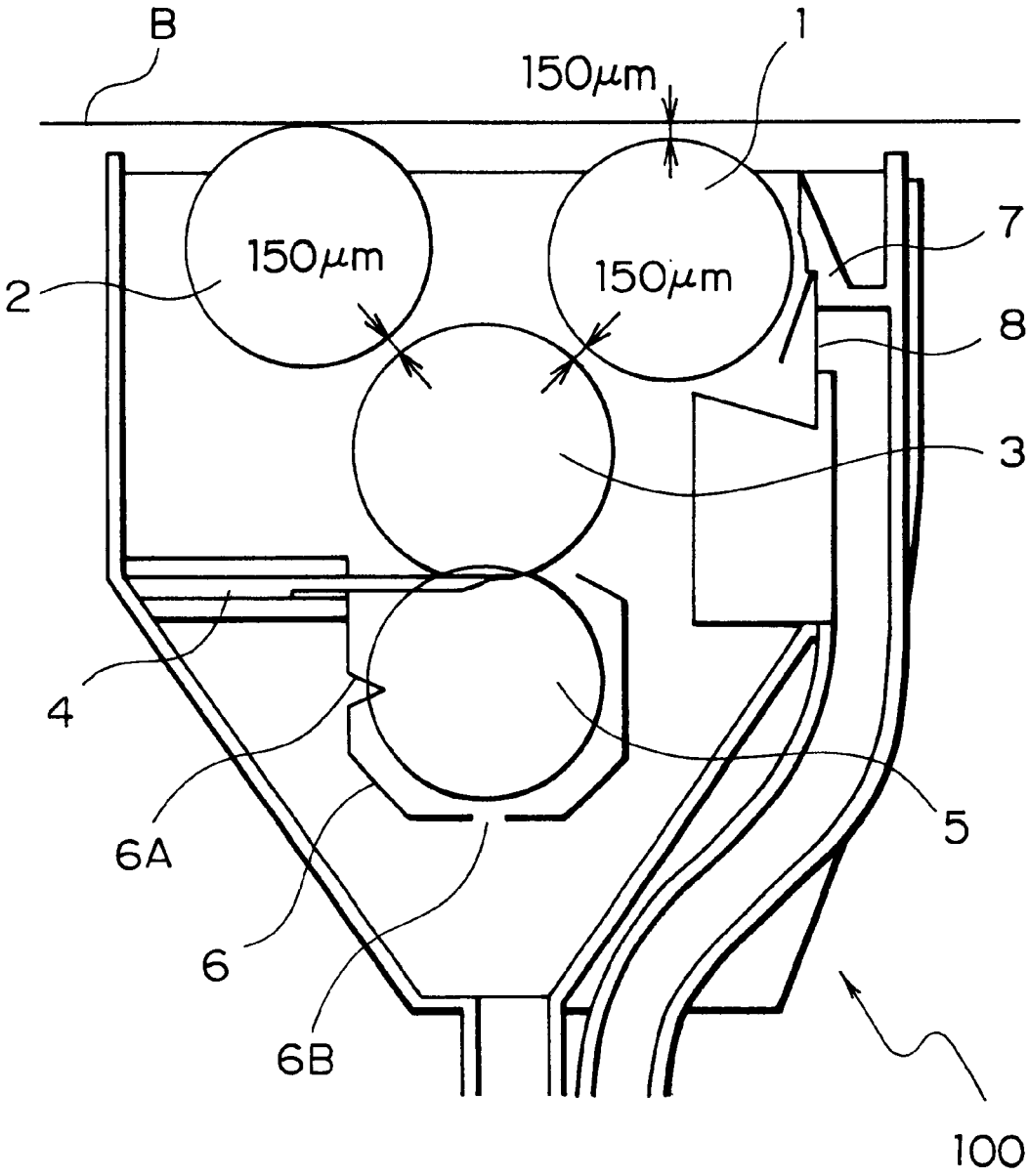
FIG. 2 is a schematic sectional view of a wet-type image forming device according to a first embodiment of the present invention.
Figure 3:
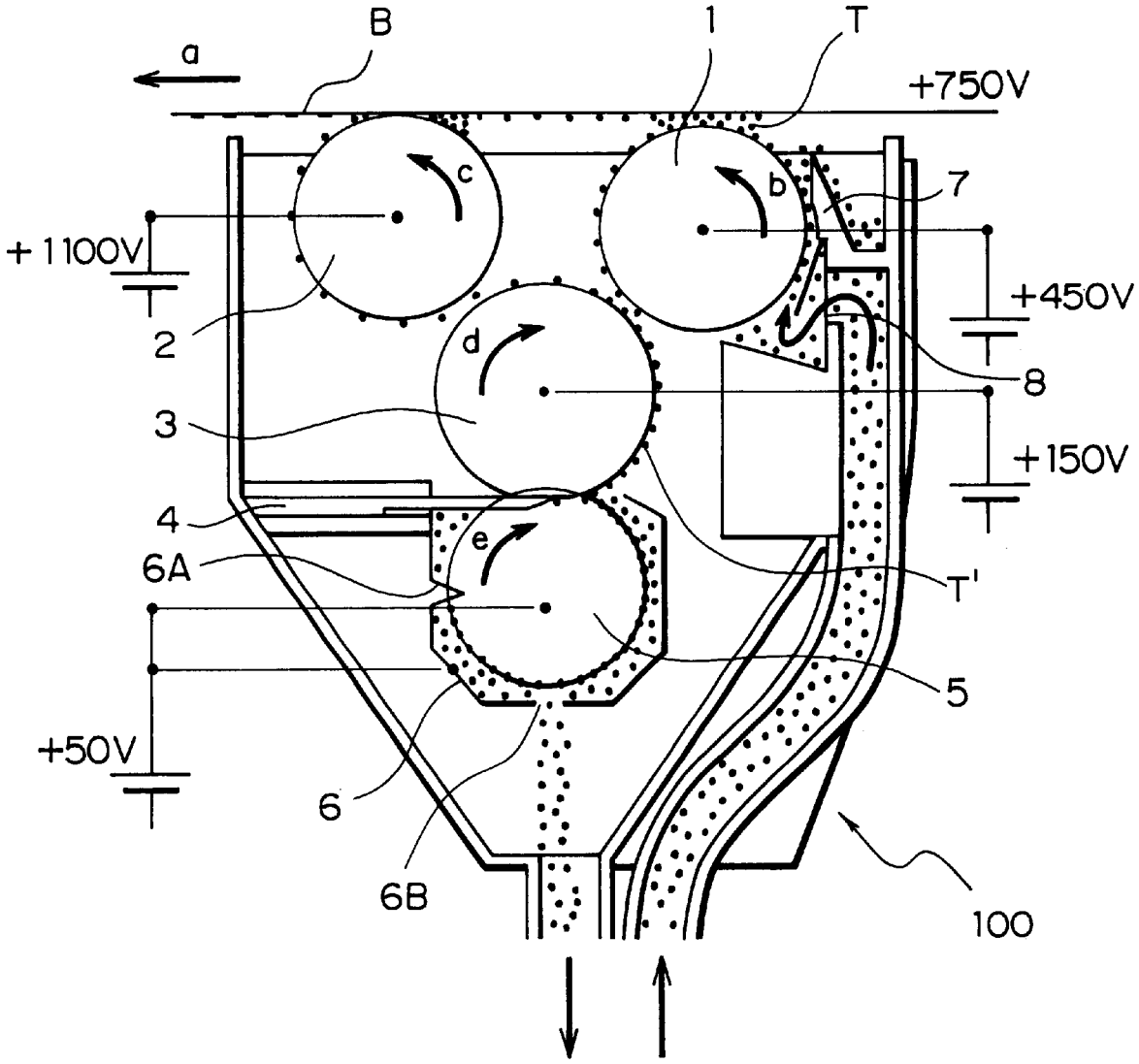
FIG. 3 is a schematic sectional view showing a state of the wet-type image forming device according to the first embodiment during image formation.

FIG. 2 is a schematic sectional view of a wet-type image forming device according to the first embodiment. FIG. 3 shows a state of the image forming device during image formation. Referring to FIGS. 2 and 3, the wet-type image forming device according to the first embodiment includes a development roller 1 which rotates in a predetermined direction to develop an electrostatic latent image formed on a photoreceptor belt B, a squeeze roller 2 which rotates in response to the movement of the photoreceptor belt B so as to squeeze off excess liquid developer T from the photoreceptor belt B, a cleaning roller 3 for cleaning the development roller 1 and the squeeze roller 2, a cleaning blade 4 and a brush roller 5 for cleaning the cleaning roller 3, a reservoir 6 for storing the liquid developer T so that the cleaning blade 4 and the brush roller 5 are immersed therein during image formation, a manifold 7 through which the liquid developer T is supplied to the development roller 1, and a shield 8 for controlling the flow of the liquid developer T.

The development roller 1 is a metallic cylindrical member, and is rotatably supported on roller bearings (not shown) at both ends thereof. During image formation, the development roller 1 is supplied with a voltage applied via the shaft ends thereof, and is disposed so as to maintain a minute gap (approximately 150 $\mu$m) relative to the photoreceptor belt B. The development roller 1 rotates in the direction of the arrow b in FIG. 3 so as to transport the liquid developer T supplied via the manifold 7 toward the minute gap, and thereby develops an electrostatic latent image formed on the photoreceptor belt B. When image formation is complete, the development roller 1 is moved sufficiently away from the photoreceptor belt B before the wet-type image forming device comes to a stop.

The squeeze roller 2 is a cylindrical member which is longer than the development roller 1, and is rotatably supported on roller bearings (not shown) at both ends thereof. The squeeze roller 2 includes a body portion composed of semiconductive urethane rubber (resistivity: $1\times10^5$ to $1\times10^9$ $\Omega\cdot$cm), and a shaft portion composed of metal. During image formation, the squeeze roller 2 is supplied with a voltage via the shaft ends thereof, and is pressed against the photoreceptor belt B with a predetermined force (30 kgf) by compression springs contained in the roller bearings (not shown). The squeeze roller 2 is frictionally driven by the movement of the photoreceptor belt B so as to rotate in the direction of the arrow c in FIG. 3, and thereby squeezes off excess liquid developer T deposited on the photoreceptor belt B. When image formation is complete, the squeeze roller 2 is moved sufficiently away from the photoreceptor belt B before the wet-type image forming device comes to a halt.

The cleaning roller 3 is a metallic cylindrical member which is as long as the squeeze roller 2, is rotatably supported on roller bearings (not shown) on both ends thereof, and is disposed so as to maintain minute gaps (approximately 150 $\mu$m each) relative to the development roller 1 and relative to the squeeze roller 2. During image formation, the cleaning roller 3 is supplied with a voltage via the shaft ends thereof. The cleaning roller 3 rotates in the direction of the arrow d in FIG. 3 to thereby remove toner particles T' from the surfaces of the development roller 1 and the squeeze roller 2.

The cleaning blade 4 is an Esterlam Doctor Blade (a plastic product) manufactured by Esterlam International Ltd. The leading edge of the cleaning blade 4 is constantly maintained in contact with the cleaning roller 3 so as to remove the toner particles T' from the cleaning roller 3.

The brush roller 5 is a cylindrical member which is as long as the cleaning roller 3, is rotatably supported on roller bearings (not shown) at both ends thereof, and is disposed so as to be constantly maintained in contact with the cleaning roller 3 and the cleaning blade 4. The brush roller 5 includes a bristle portion composed of plastic fiber such as rayon and nylon fibers (resistivity: $1\times10^3$ to $1\times10^6$ $\Omega\cdot$cm), and a shaft portion composed of metal. During image formation, the brush roller 5 is supplied with a voltage via the shaft ends thereof, and rotates in the direction of the arrow e in FIG. 3 to thereby remove toner particles T' from the surfaces of the cleaning roller 3 and the cleaning blade 4.

The reservoir 6 is a metallic plate member. During image formation, because more liquid developer T enters the reservoir 6 than flows out through an aperture 6B on the bottom thereof, the liquid developer T accumulates in the reservoir 6 so that the brush roller 5 and the cleaning blade 4 are immersed therein. When image formation is complete, the liquid developer T accumulated in the reservoir 6 flows out through the aperture 6B to empty the reservoir 6. A portion of one side of the reservoir 6 is bent in a V-shape to protrude inwardly. The V-shaped protrusion 6A is in contact with the brush roller 5 so as to scrape toner particles T' from the brush roller 5. During image formation, the reservoir 6 is supplied with the same voltage as the brush roller 5.

Figure 4:
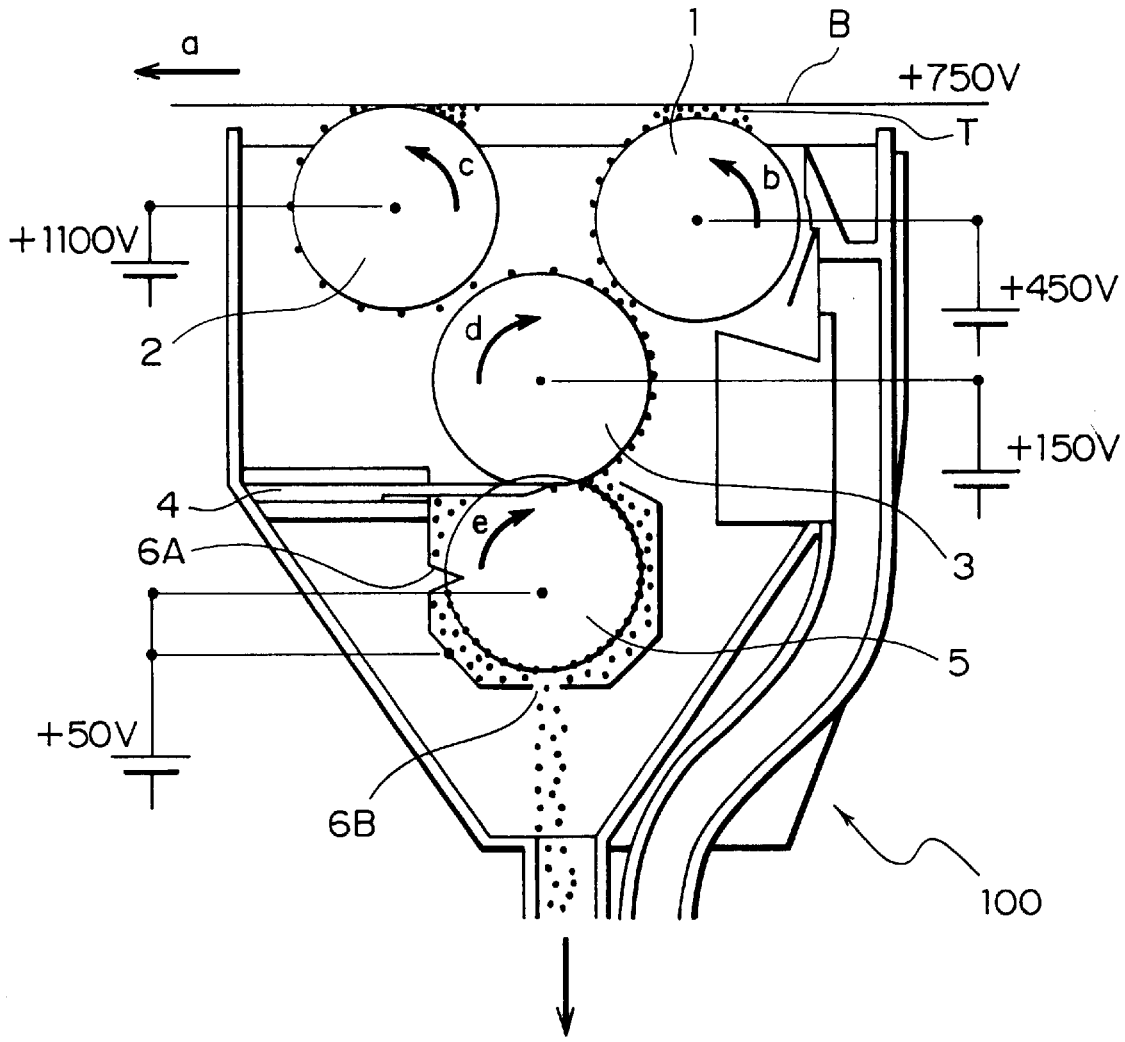
FIG. 4 is a schematic sectional view showing a state of the wet-type image forming device according to the first embodiment during removal of toner particles.
Figure 5:
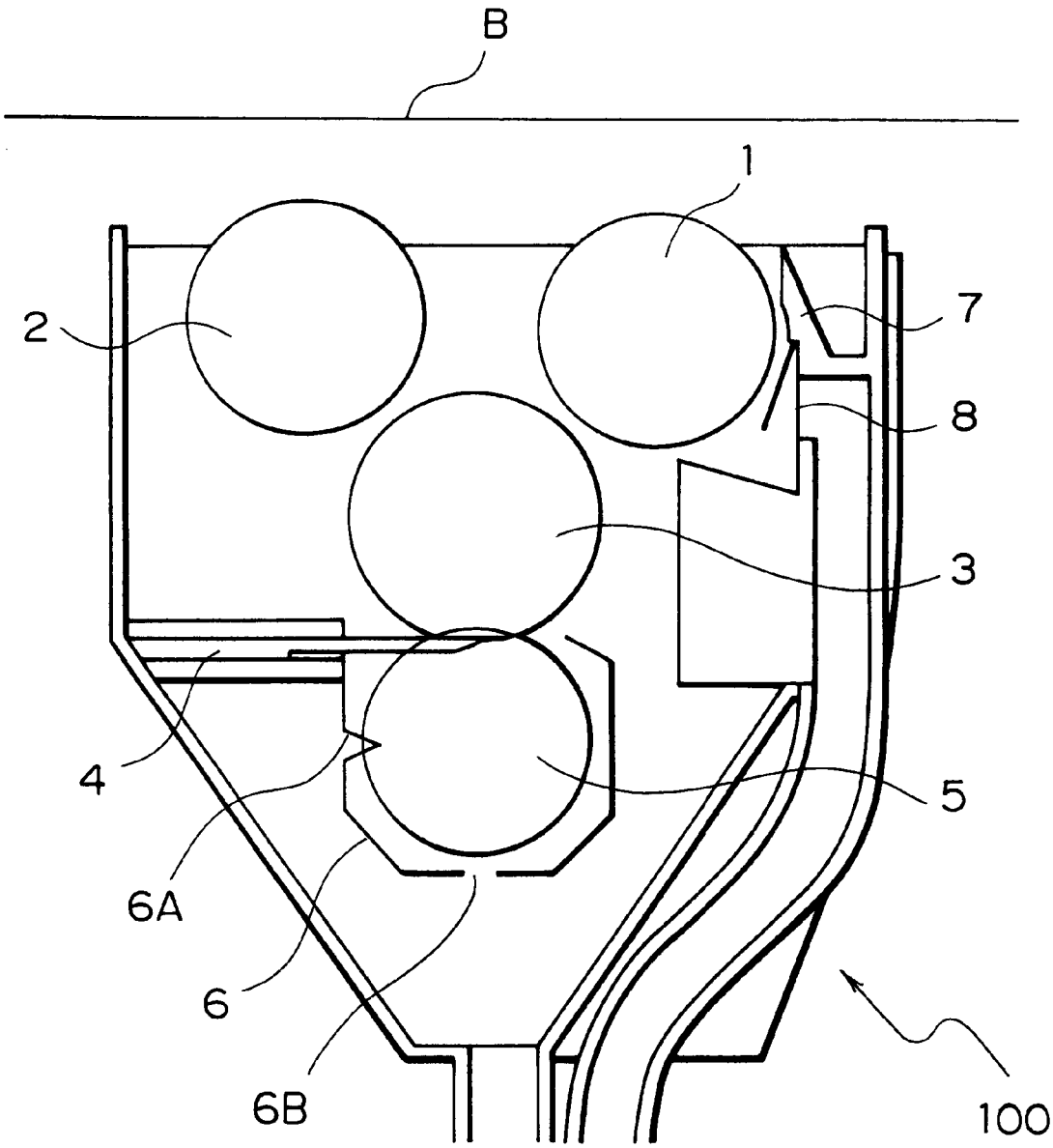
FIG. 5 is a schematic sectional view showing a state of the wet-type image forming device according to the first embodiment when the device is stopped.
Figure 6:
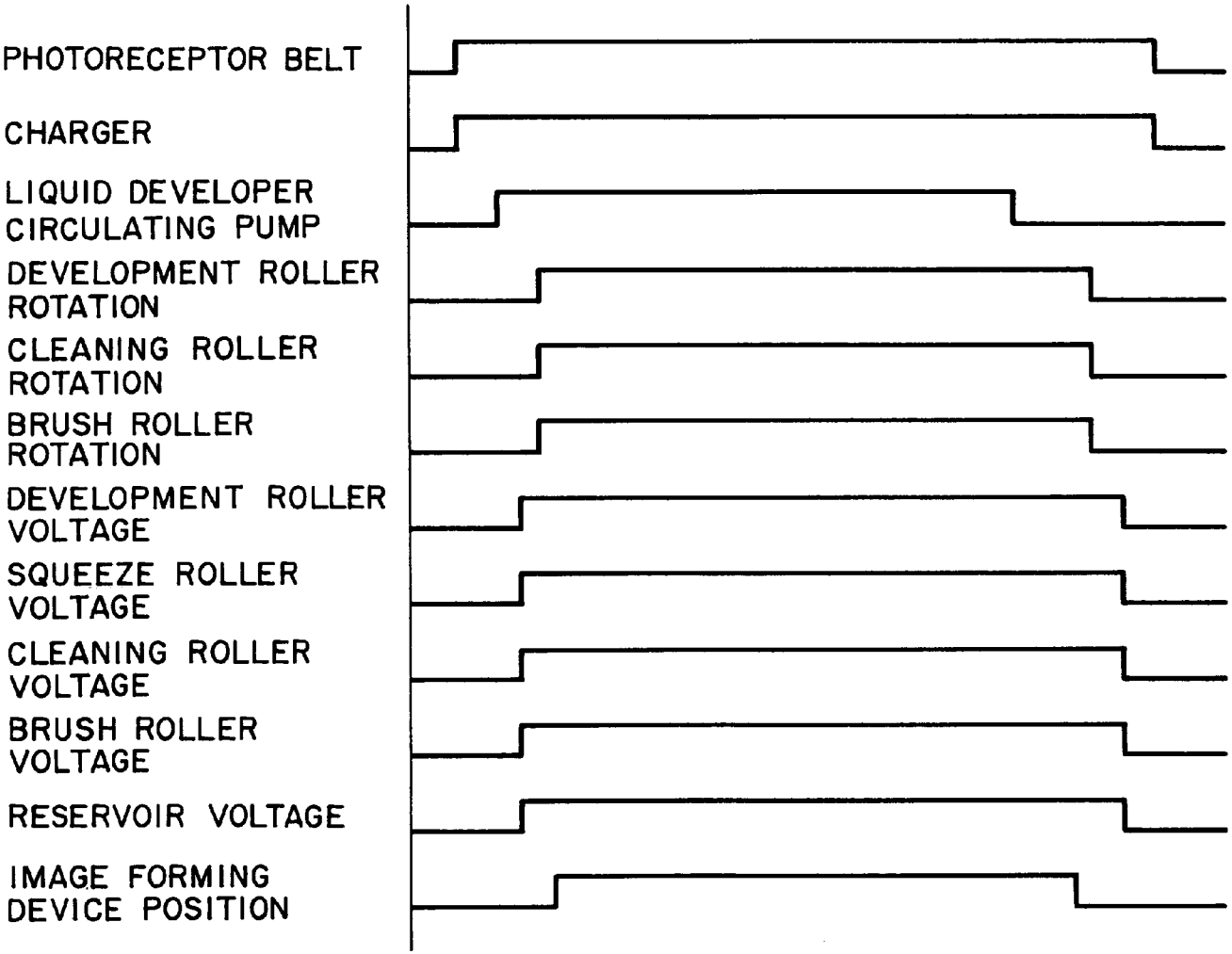
FIG. 6 is a sequence diagram of an operation of the wet-type image forming device according to the first embodiment.

The operation of the wet-type image forming device will now be described with reference to FIGS. 3 to 6. FIGS. 3 to 5 each illustrate an operational state of the wet-type image forming device. FIG. 3 shows, as previously mentioned, a state of the wet-type image forming device during image formation. FIG. 4 shows a state of the wet-type image forming device during removal of toner particles T' in the liquid developer T accumulated in the gap between the photoreceptor belt B and the development roller 1 and in the gap between the photoreceptor belt B and the squeeze roller 2. FIG. 5 shows the wet-type image forming device in a stopped state. FIG. 6 is a sequence diagram of an operation of the wet-type image forming device, in which time is represented on the horizontal axis, operational steps are represented on the vertical axis, and a rising edge and a falling edge of graphed lines indicates, respectively, activation and deactivation of the corresponding item.

When original image data is received, the photoreceptor belt B starts to move in the direction of the arrow a in the Figures, while being charged to +750 V by a scorotron charger (not shown). Thereafter, a liquid developer circulating pump (not shown) starts operating to supply positively charged liquid developer T to the development roller 1 via the manifold 7. The development roller 1, the cleaning roller 3, and the brush roller 5 start rotating, while the development roller 1 is charged to +450 V, the squeeze roller 2 to +1100 V, the cleaning roller 3 to +150 V, the brush roller 5 and the reservoir 6 to +50 V. In the reservoir 6, liquid developer T accumulates so that the cleaning blade 4 and the brush roller 5 are immersed therein. Then, a cam (not shown) for moving the wet-type image forming device up and down rotates so that the wet-type image forming device is lifted from the inactive position to the active position. When the wet-type image forming device is lifted in the active position, the development roller 1 is disposed in a position so as to maintain a 150 $\mu$m gap relative to the photoreceptor belt B, while the squeeze roller 2 is pressed against the photoreceptor belt B with a 30 kgf force by compression springs contained in the roller bearings. Then, a laser unit performs an exposure process (areas exposed to light are discharged to approximately 130 V) to form a latent image on the photoreceptor belt B.

The positively charged liquid developer T supplied from the manifold 7 is transported towards the gap between the photoreceptor belt B and the development roller 1, i.e., the nip, by the rotation of the development roller 1 in the direction of the arrow b in FIG. 3. A latent image on the photoreceptor belt B passing through the gap is developed under an electric field generated between discharged areas of the photoreceptor belt B having been exposed to light and the development roller 1 (i.e., by the potential difference between the +130 V exposed areas and the +450 V development roller). At this time, a reverse development occurs, i.e., toner particles T' adhere to the circumference of the development roller 1, under an electric field generated between non-discharged areas of the photoreceptor belt B not having been exposed to light and the development roller 1 (i.e., by the potential difference between the +750 V unexposed areas and the +450 V development roller). The toner particles T' having adhered to the circumference of the development roller 1 are removed therefrom to sequentially adhere to the cleaning roller 3, under an electric field generated between the development roller 1 and the cleaning roller 3 disposed so as to maintain a 150 $\mu$m gap therewith (i.e., by the potential difference between the +450 V development roller and the +150 V cleaning roller).

On a freshly developed image on the photoreceptor belt B, excess liquid developer T is present. The excess liquid developer T is squeezed off by the squeeze roller 2 pressed against the photoreceptor belt B by compression springs with a 30 kgf force, so that the image on the photoreceptor belt B is made into a film. At this time, a portion of the toner particles T' constituting the image adhere to the surface of the squeeze roller 2. The toner particles T' having adhered to the squeeze roller 2 are removed therefrom to sequentially adhere to the cleaning roller 3, under an electric field generated between the squeeze roller 2 and the cleaning roller 3 disposed so as to maintain a 150 $\mu$m gap therewith (i.e., by the potential difference between the +1100 V squeeze roller and the +150 V cleaning roller).

The toner particles having adhered to the cleaning roller 3 are in large part removed therefrom to sequentially adhere to the brush roller 5, electrically under an electric field generated between the cleaning roller 3 and the brush roller 5 (i.e., by the potential difference between the +150 V cleaning roller and the +50 V brush roller), and mechanically by opposing rotation of the cleaning roller 3 and the brush roller 5 in contact therewith. Toner particles T' remaining on the cleaning roller 3 are scraped off by the cleaning blade 4, constantly maintained in contact with the cleaning roller 3 at the leading edge thereof, so as to also adhere to the brush roller 5. Thus, toner particles T' are completely removed from the cleaning roller 3.

The toner particles T' adhering to the brush roller 5 are scraped therefrom by the V-shaped protrusion 6A on one side of the reservoir 6 charged to the same potential +50 V as the brush roller 5, and are then redispersed among the liquid developer T stored within the reservoir 6 by the rotation of the brush roller 5. The liquid developer T containing toner particles T' subsequently flows out through the aperture 6B at the bottom of the reservoir 6 by gravity and is then recovered in a liquid developer tank (not shown). The liquid developer T recovered into the liquid developer tank is then supplied again from the manifold 7 to the development roller 1 by the liquid developer circulating pump (not shown).

The filmed image on the photoreceptor belt B proceeds to the drying unit (not shown) for drying, and further proceeds to the transfer unit (not shown) so that the image is transferred onto a sheet of paper.

When image formation is complete, the liquid developer circulating pump (not shown) for supplying the liquid developer T stops. Then, toner particles T' in the liquid developer T having accumulated in the gap (approximately 150 $\mu$m) between the photoreceptor belt B and the development roller 1, and toner particles T' in the liquid developer T having accumulated in the gap between the photoreceptor belt B and the squeeze roller 2, upstream of the contact therebetween, are removed.

When the toner particles T' have been removed as described above, a cam (not shown) rotates, so that the wet-type image forming device is moved down to the inactive position. Then, the development roller 1, the cleaning roller 3, and the brush roller 5 stop rotating, and the liquid developer T within the reservoir 6, by gravity, thoroughly flows out through the aperture 6B at the bottom thereof to empty the reservoir 6. Any remaining voltages are removed and the photoreceptor belt B stops.

In a second embodiment of the present invention, a bristle portion of a brush roller 5 is composed of semiconductive urethane foam (resistivity: $1\times10^3$ to $1\times10^6$ $\Omega\cdot$cm). The second embodiment is otherwise identical to the first embodiment.

In a third embodiment of the present invention, the V-shaped protrusion 6A on one side of the reservoir 6, as in the first embodiment, is omitted. Instead, the arrangement is such that a blade made of either metal or plastic is in contact with a brush roller 5 so as to scrape toner particles therefrom. The third embodiment is otherwise identical to the first embodiment.

As is apparent from the above description, according to the present invention, a cleaning roller is cleaned both electrically and mechanically, so that toner particles are fully removed from the surface of the cleaning roller.

Furthermore, according to the present invention, a brush roller for cleaning a cleaning roller is constantly cleaned, so that the ability to clean the cleaning roller does not diminish over an extended period of image forming operations.

What is claimed is:

1. A wet-type imaging forming device comprising:

a development roller for developing, using a liquid developer containing toner particles, an electrostatic latent image formed on a photoreceptor;

a squeeze roller for squeezing off excess liquid developer from said photoreceptor;

a cleaning roller for cleaning said development roller and said squeeze roller, wherein a voltage is applied to the cleaning roller; and a brush roller and a cleaning blade for cleaning said cleaning roller, wherein a voltage is applied to said brush roller that is less than the voltage applied to said cleaning roller.

2. A wet-type image forming device according to claim 1, wherein a bristle portion of said brush roller comprises plastic fiber.

3. A wet-type image forming device according to claim 1, wherein a bristle portion of said brush roller comprises semiconductive urethane foam.

4. The wet-type image forming device according to claim 1, further comprising a reservoir containing a protrusion in contact with said brush roller whereby said toner particles are scraped from the brush roller.

5. The wet-type image forming device of claim 4, wherein the protrusion comprises an angular portion of a metallic wall of the reservoir having a V shaped edge.

6. The wet-type image forming device according to claim 1, wherein the brush roller is selectively brought into direct contact with the cleaning roller.

7. The wet-type image forming device according to claim 1, wherein said brush roller is constantly cleaned.

8. An electrophotographic apparatus comprising a wet-type imaging forming device, wherein said imaging forming device includes:

a development roller for developing, using a liquid developer, an electrostatic latent image formed on a photoreceptor;

a squeeze roller for squeezing off excess liquid developer from said photoreceptor;

a cleaning roller for cleaning said development roller and said squeeze roller, wherein a voltage is applied to the cleaning roller; and a reservoir for storing said liquid developer, said reservoir containing a brush roller and a cleaning blade for cleaning said cleaning roller which is immersed therein during image formation, wherein a voltage is applied to said brush roller and the reservoir that is less than the voltage applied to the cleaning roller.

9. A wet-type image forming device according to claim 8, wherein the same voltage is applied to said brush roller and to said reservoir.

10. A wet-type imaging forming device comprising:

a development roller for developing, using a liquid developer containing toner particles, an electrostatic latent image formed on a photoreceptor;

a squeeze roller for squeezing off excess liquid developer from said photoreceptor;

a cleaning roller for cleaning said development roller and said squeeze roller, wherein a voltage is applied to the cleaning roller; and a brush roller and a cleaning blade for cleaning said cleaning roller, wherein a voltage is applied to said brush roller that is less than the voltage applied to said cleaning roller; and a reservoir for storing said liquid developer so that the brush roller is immersed therein during image formation, wherein said reservoir has a protrusion for scraping toner particles from said brush roller.

11. A wet-type image forming device according to claim 10, wherein said protrusion comprises a blade.

12. A wet-type imaging forming device comprising:

a development roller for developing, using a liquid developer containing toner particles, an electrostatic latent image formed on a photoreceptor;

a squeeze roller for squeezing off excess liquid developer from said photoreceptor;

a cleaning roller for cleaning said development roller and said squeeze roller, wherein a voltage is applied to the cleaning roller;

a brush roller and a cleaning blade for cleaning said cleaning roller, wherein a voltage is applied to said brush roller that is less than the voltage applied to said cleaning roller; and a reservoir for storing said liquid developer so that said brush roller is immersed therein during image formation, wherein said reservoir has a protrusion for scraping toner particles from said brush roller.

13. A wet-type image forming device according to claim 12, wherein a voltage is applied to said reservoir.

14. The wet-type image forming device of claim 12, wherein the protrusion comprises an angular portion of a metallic wall of the reservoir having a V shaped edge.

15. The wet-type image forming device according to claim 12, wherein the brush roller is selectively brought into direct contact with the cleaning roller.

16. The wet-type image forming device according to claim 12, wherein said brush roller is constantly cleaned.

* * * * *